US005398093A

United States Patent [19]

Carozzi

[11] Patent Number: 5,398,093

[45] Date of Patent: Mar. 14, 1995

[54] APPARATUS FOR THE AUTOMATIC DEVELOPMENT OF X-RAY FILMS, IN PARTICULAR IN DENTAL FIELD

[75] Inventor: Giorgio Carozzi, Milan, Italy

[73] Assignee: Eurodent, S.p.A, San Lazzaro di Savena Bo, Italy

[21] Appl. No.: 28,314

[22] Filed: Mar. 9, 1993

[30] Foreign Application Priority Data

Mar. 10, 1992 [IT] Italy ..... MI92A0540

[51] Int. Cl.[6] ..... G03D 3/08; G03D 13/02

[52] U.S. Cl. ..... 354/323; 354/331; 354/336; 354/324

[58] Field of Search ..... 354/324, 331, 336, 323, 354/; 134/64 R, 64 P, 122 P, 122 R

[56] References Cited

U.S. PATENT DOCUMENTS

| | | | |
|---|---|---|---|
| 2,989,911 | 6/1961 | Winnek | 354/323 |
| 3,508,483 | 4/1970 | Weider et al. | 354/323 |
| 3,792,487 | 2/1974 | Peres | 354/323 X |
| 4,134,665 | 1/1979 | Wada et al. | 354/323 |
| 5,235,372 | 8/1993 | Blumé | 354/323 |

FOREIGN PATENT DOCUMENTS

| | | |
|---|---|---|
| 245906 | 11/1987 | European Pat. Off. . |
| 554005 | 9/1974 | Switzerland . |
| 2154905 | 3/1984 | United Kingdom . |

*Primary Examiner*—D. Rutledge
*Attorney, Agent, or Firm*—Collard & Roe

[57] ABSTRACT

An apparatus for quick and automatic development of X-ray films, comprising a treatment container whith a bottom shaped like a trapezoid catch well provided with circular holes whose edge is on the same level and flush with the bottom of the catch well, said holes forming slide and/or ledge housings for the tight-fitting element of diaphragm valves placed between the treatment container and the storage and collection containers of the treatment solutions, the circulation of fluids and the driving of such valves being preferably obtained pneumatically.

4 Claims, 3 Drawing Sheets

APPARATUS FOR THE AUTOMATIC DEVELOPMENT OF X-RAY FILMS, IN PARTICULAR IN DENTAL FIELD

BACKGROUND OF THE INVENTION

1. Field of Invention

The object of the present invention is an apparatus for quick and automatic development of X-ray plates and films, utilizable even by non expert people and without using a camera oscura, in particular in dentist's surgery, first-aid stations, and the like.

2. The Prior Art

There have been described in the literature apparatuses for quick and automatic development of X-ray films utilizable for instance in dentist's surgery, which allow dentists to ascertain on the spot the conditions of the patient and even to follow radiographically during the operation the progress of treatment and the results.

For instance, in U.S. Pat. No. 3508483, an apparatus is described made up by a parallelepipedal tray in which films or plates to be developed are placed and into which the different treatment fluids are conveyed in succession from the respective containers whereto they are reconveyed thereafter, on completion of each treatment stage. According to the description of said patent, a pluri-way valve or a solenoid valve associated to the tray is utilized for the introduction of the different fluids into the tray and their return into the respective container.

SUMMARY OF THE INVENTION

According to the European Patent Application No. 87200836.2 (Carozzi S.p.A.), an apparatus for quick and automatic development of X-ray films is made up by a tray-shaped container containing the plates to be developed and by several containers containing the treatment fluids, which are connected to the tray by means of tubes via a pneumatic pluri-way valve.

The severe drawback of said apparatuses as well as other similar ones known in prior art is that after each emptying out of the tray a small amount of treatment fluid still remains in the connection pipes and/or the ducts and the valve housing, and said fluid mixes with the treatment fluid of the following stage, polluting it and alterating quickly its characteristics and composition. As a consequence, after a certain number of operations, the quality of development worsens and one has therefore to either adjust the treatment times to the variations of composition of fluids - which is not easy when the apparatus is utilized by people who are not expert in the photographic field - or to substitute all the solutions, which involves expenses and remarkable drawbacks because of the ecological restrictions which limit fluid discharge, and because of the emptying and washing operations of the apparatus and its refilling and restoration with fresh fluids.

A purpose of the present invention is the realization of an apparatus for the automatic development of X-ray films and plates such as to be utilizable for a great number of operations without pollutions and/or alterations taking place in the treatment solutions, which eliminates the need of adjusting the treatment conditions and/or frequently emptying out and restoring the solutions.

Another purpose of the present invention is the realization of an apparatus for the automatic development of X-ray films, such as to be particularly suitable and useful for dentist's surgery personnel, with reduced dimensions, easily usable, and utilizing services that are already largely available in dentist's surgery and dental laboratories.

Another purpose of the invention is the realization of an apparatus of the above mentioned type provided with adjustable programming devices such as to permit the execution of treatment cycles even of different duration, but always with high reliability and performance constancy, and therefore in conditions of high reproducibility.

Still another purpose of the invention is the realization of an automatic development apparatus of simple structure, highly reliable and easily and quickly programmable through an electronic exchange system either incorporated or associated to said apparatus.

These and still other objects and relating advantages which will be illustrated more clearly in the following description are reached by an apparatus for quick and automatic development of X-ray films and plates, made up by a container designed to contain said films and plates, a set of containers for the storage and collection of several treatment fluids, means for conveying in succession said fluids into said treatment container and for the return of said fluids each into the respective storage and collection container, said apparatus comprising, according to this invention:

a treatment container designed to contain said films and plates to be developed, whose bottom has the shape of an almost trapezoid catch well, round holes being provided in both opposite side walls of said container, the lowest point of the circumference of said holes being on the same level and flush with the bottom of said trapezoid catch well, said round holes being so shaped as to form slide and/or ledge housings for the tight-fitting closing elements of a diaphragm valve;

at least a first and a second storage and collection container, for the developing solution and the fixing solution respectively, and at least a third storage and collection container for distilled or deionized washing water, a suction tube communicating through said round holes with said treatment container being tight-fitted in each of said containers;

diaphragm valves, associated to said round holes, placed each between said storage and collection containers and said treatment container, through said suction tubes, said valves being provided with a suitable tight-fitting closing element so that said element, once closed, is on the same level and/or flush with the edge of said hole and therefore on the same level and flush with said bottom of said catch well, said valves being driven in succession according to a preset-time intervention programme;

means for conveying pressurized air into said storage and collection container, so as to convey intermittently and for preset permanence periods of time the developing solution, the fixing solution, and then the washing water into said treatment container, with a spontaneous return, by gravity, of said fluids after the treatment cycle, into the respective storage and collection containers through said holes and said suction tubes;

a case enclosing said treatment container and the relating devices, provided with porthole openings or similar openings with flexible closing curtains, such as to permit the introduction of the operator's hands for positioning the X-ray plates in said treatment container in the absence of ambient light;

being lastly provided, for the automatic realization of the succession of treatment cycles, an electronic exchange control system incorporating programmed timers adjustable according to the duration required for the treatment cycles and the characteristics of the utilized fluids.

Said storage and collection containers for the developing solution and the fixing solution may be thermostated, for instance by means of resistors incorporated in their base or by water ciculation within a suitable resistor-heated cavity.

Washing water, instead of being brought back into its container upon conclusion of the washing stage, may be discharged without being recovered.

According to the present invention, said circular holes are in number of three, two of them being advantageously located side-by-side in one of the two side walls of said treatment container, the third hole being located in the opposite wall. The two holes located side-by-side are as close as possible to one another, the distance between them being determined chiefly by the overall dimensions of the valves associated to said round holes.

Said diaphragm valves may be advantageously made up by a type of valve provided with two diaphragms, a return spring and a head or piston driven by compressed air through one of the diaphragm, and the spring respectively; the head is translable in both directions, remaining tight-fitted in the housing constituted by the hole in the wall of the tray, so that the head, in closing position, is flush with the bottom of the catch well. With this type of valve, the introduction of air in the special compartment, acting on a diaphragm placed in the back of the valve, causes the head to move backwards, opening the hole and compressing the spring, which remains compressed until there is air in the compartment; in rest position, the spring returns the head in closing position.

Another diaphragm valve advantageously utilized according to the invention is constituted by a valve comprising a box-shaped body communicating with the source of compressed air or other suitable fluid. A diaphragm on which the pressurized air or the other fluid acts directly, pushing it and keeping it tightly pressed, in closing position, against said round ledge hole, on the same level and flush with the bottom of the trapezoid catch well, and against a second hole communicating with the storage and collection container of the treatment fluid. The ledge hole and said second hole being located in the almost spherical bending of a recess placed in the wall of said treatment container, so that said diaphragm can tightly adhere to said bending. In this case, the valve is closed when there is compressed air in the box-shaped body, while it is open when the valve is in rest position.

BRIEF DESCRIPTION OF THE DRAWINGS

A preferential, non exlusive embodiment of the invention is described with more details in the following, whereby reference is made to the attached drawings, which are given only as an indication and not a limitation, wherein:

FIG. 2 shows, always schematically in cross-section, an enlarged detail of the treatment container in correspondence of one of the round holes along the 2—2 line of FIG. 1, and a longitudinal section of one of the diaphragm valves, of the type provided with two diaphragms, return spring and closing head, while

DETAILED DESCRIPTION OF THE PREFERRED EMBODIMENT

Figure 1:
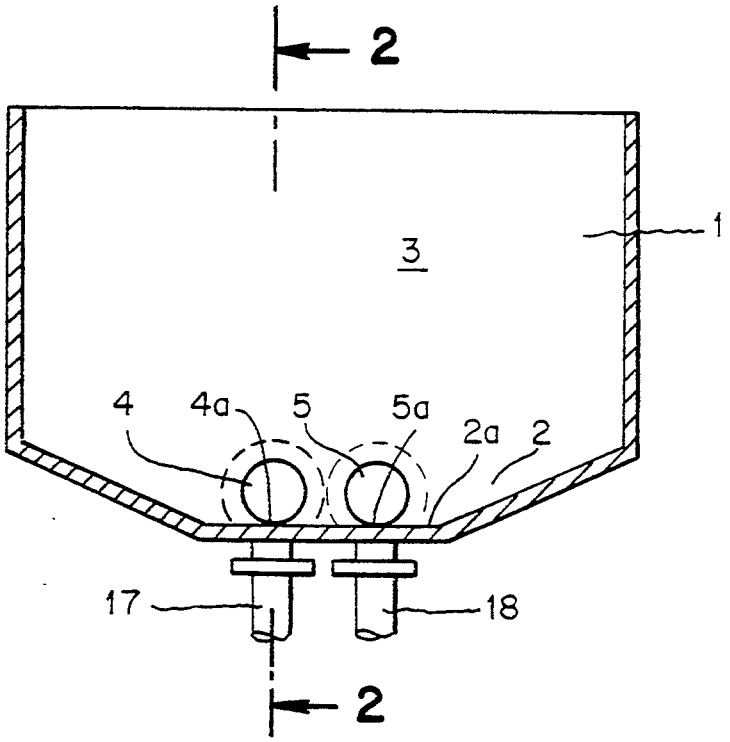
FIG. 1 shows schematically a longitudinal section of the treatment container.

The apparatus according to the present invention comprises the flat parallelepipedal treatment container 1 with the almost trapezoid catch well-shaped bottom 2. In side wall 3 of the treatment container, two round holes 4 and 5 are provided which are on the same level and flush with bottom *2a* of the trapezoid catch well 2 in points *4a* and *5a*, respectively.

The containers, which are placed underneath, contains a developing solution, a fixing solution and the washing water respectively. In the containers, which have preferably the shape of a tapered-or-threaded-neck bottle, are inserted suction tubes whose top ends are connected, through distinct pipes 17, 18, 19, to distinct pneumatic diaphragm valves 7, 16, 41. The delivery of the valves communicates with the inside of treatment container 1 through the holes which constitute the slide and ledge housings for the heads of the respective valves. If so required by the type of fluids utilized and the ambient climate conditions, the containers may be themostated by means of resistors or by means of heated water circulating in cavities.

Figure 2:
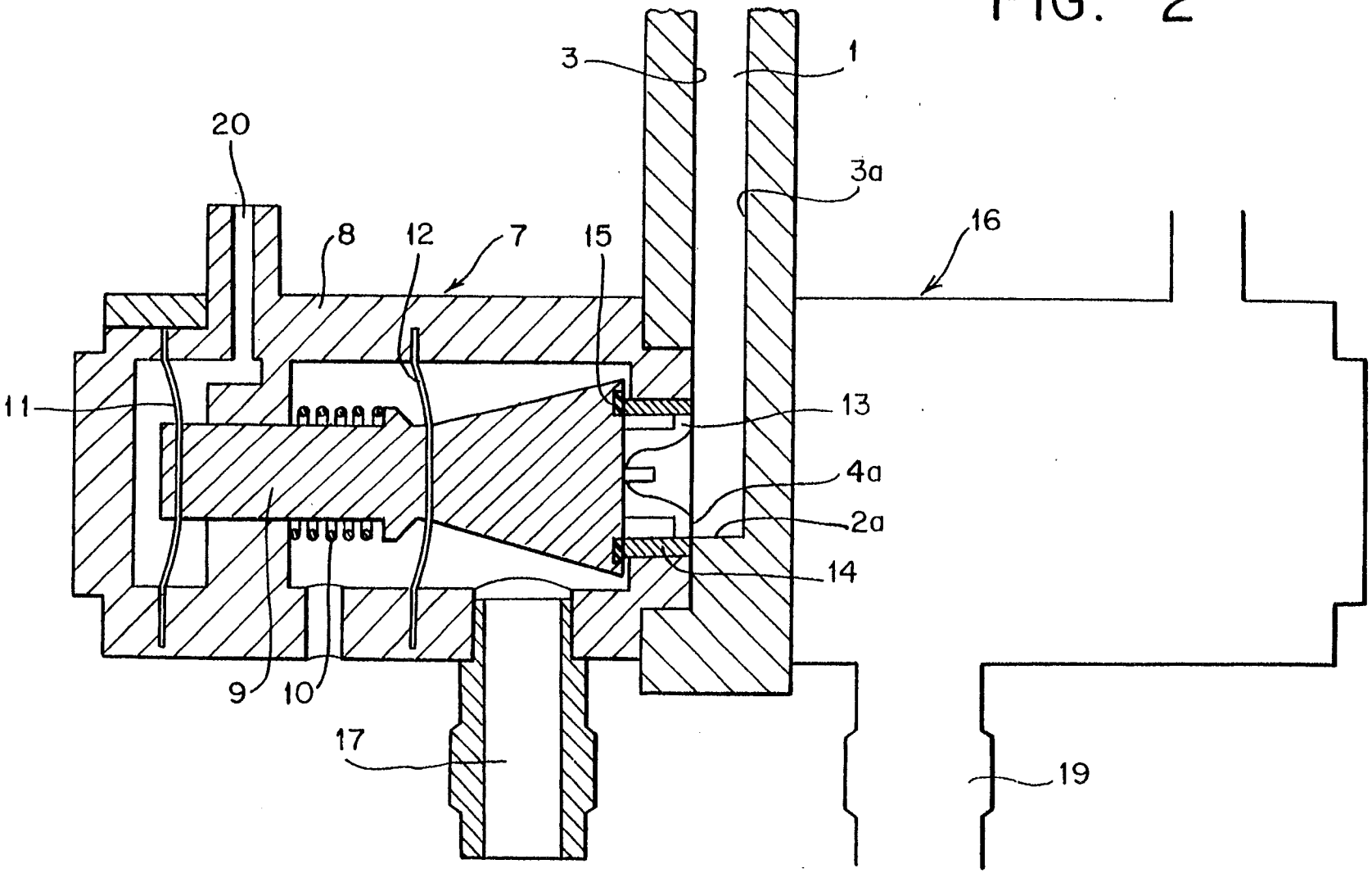

FIG. 2 shows a section of diaphragm valve 7 for the developing solution or the fixing solution, placed in correspondence of hole 4 in wall 3 of the treatment container. Valve 7 is constituted by a shell 8 which houses stem 9, the latter being provided with the return spring 10, air diaphragm 11 and fluid diaphragm 12. Stem 9 is also provided with head 13 translable within bushing 14 which constitutes its slide and ledge housing. Tightness is ensured by contact between head and bushing, and also by the annular gasket 15. FIG. 2 shows also valve 16 utilizable for the washing water, placed in correspondence of hole 4 of the trapezoid catch well, in opposite position with regards to the other two valves. The compressed air, introduced through 20, drives diaphragm 11 which shifts in opening position stem 9 with the related head 13 by compressing spring 10, permitting in this way the treatment fluid, pressurized in its not shown storage and collection container, to enter into treatment container 1, passing through the suction tubes and pipe 17. Once completed the treatment stage is completed, compressed air reopens the valve by acting again on diaphragm 11, causing the stem and the associated head to move back, and the treatment fluid returns by gravity into its storage and collection container.

Figure 3:
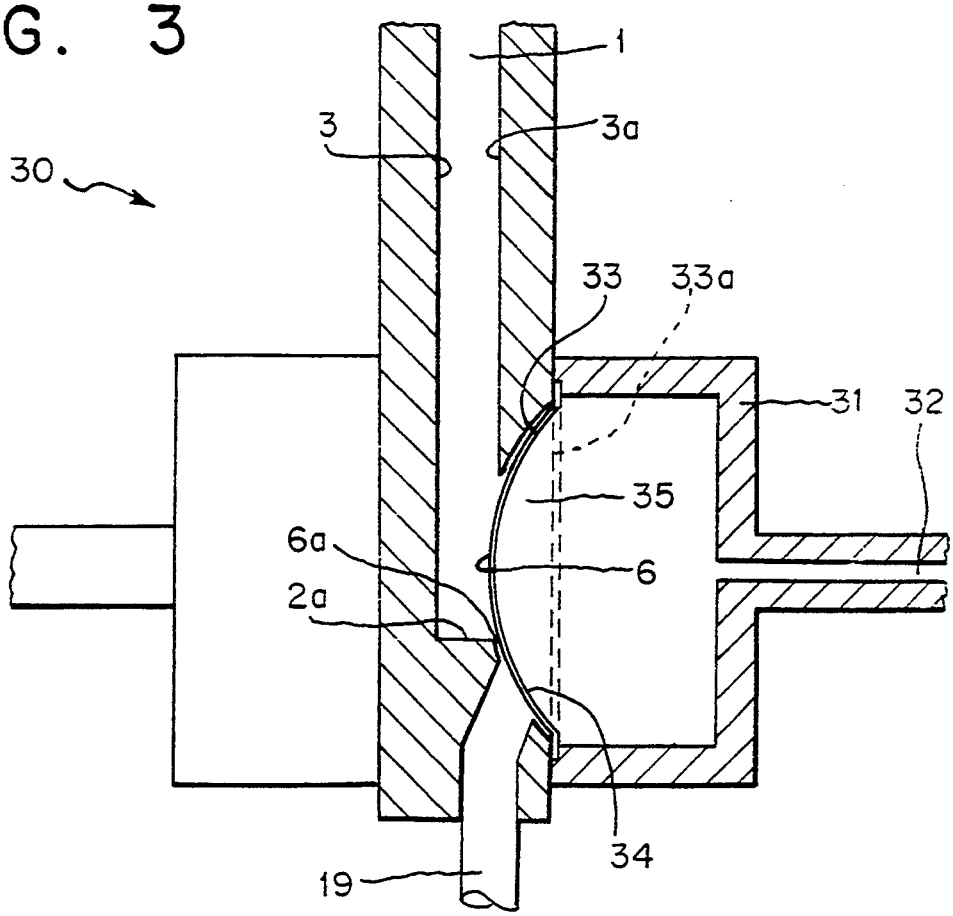
FIG. 3 shows, always schematically and in crosssection, a diffent type of valve with one single diaphragm.

FIG. 3 shows schematically, in closed position, diaphragm valve 30, of the one single diaphragm type, placed in correspondence of hole 6 in the wall of the treatment container. Valve 30 is constituted by the box-shaped body 31 communicating with the compressed air source through duct 32, and is provided with diaphragm 33, shown in closing position of hole 6 and of hole 34, the latter hole providing communication with the container treatment fluid, which is not shown, through duct 19. Hole 6 in point *6a* is on the same level and flush with bottom *2a* of the trapezoid catch well 2.

Holes 6 and 34 are located in the almost spherical bending of recess 35 placed in the wall of the treatment container 1. When opened, the valve diaphragm is in resting position 33*a*, so that the catch well of treatment tray 1 communicates with duct 19 through recess 35.

Figure 4:
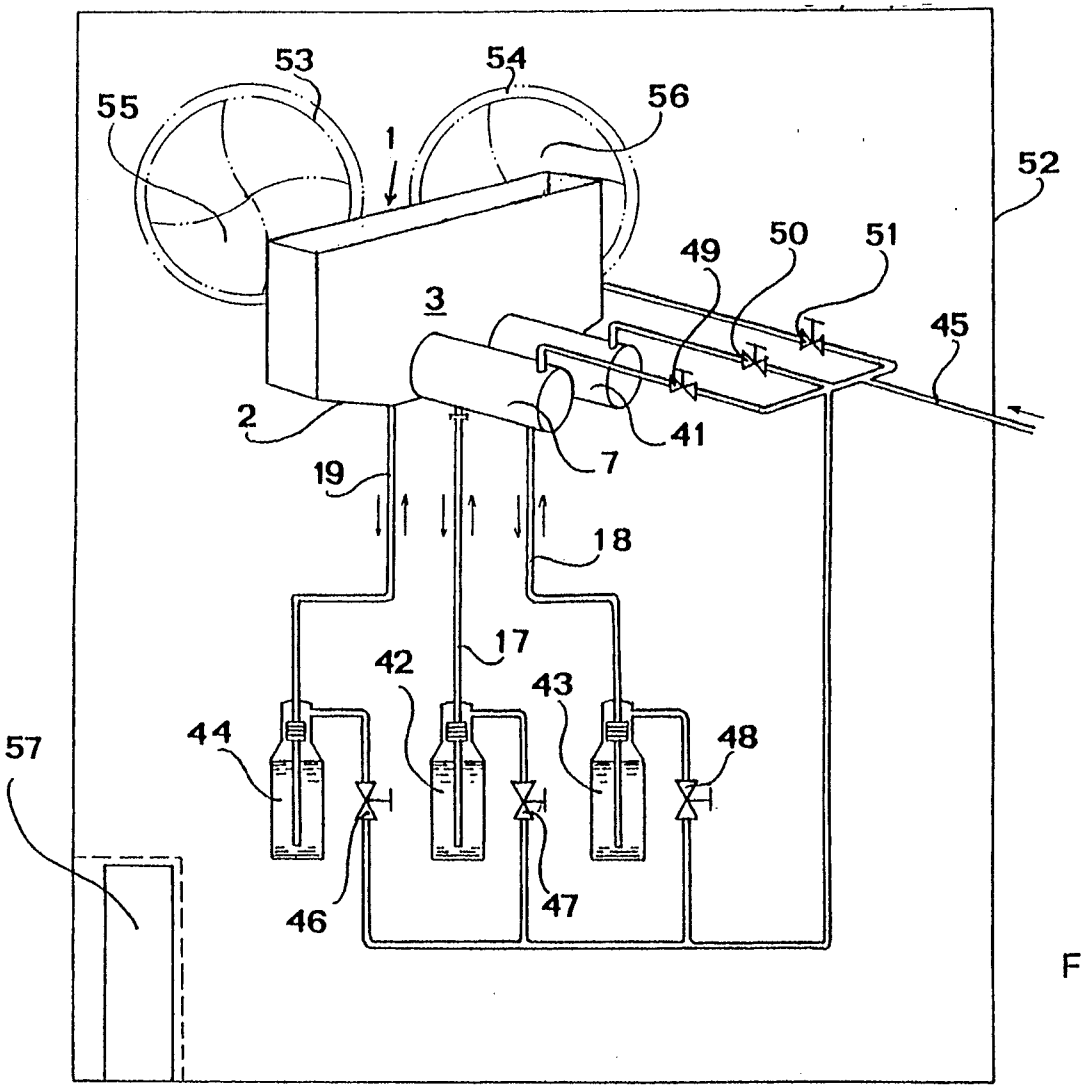
FIG. 4 shows schematically an apparatus for quick and automatic development of X-ray films and plates according to the invention.

FIG. 4 shows schematically the apparatus for the automatic development of X-ray films according to the invention. The apparatus comprises a treatment container 1 with trapezoid bottom 2. In side wall 3, two diaphragm valves and 41 are provided. A third diaphragm valve 16 is provided in the opposite side wall and is not visible in this view.

The first storage and collecting container 42 contains a developing solution and communicates with the treatment container 1 through the suction tube 17 and the diaphragm valve 7. The second storage and collecting container 43 contains a fixing solution and communicates with the treatment container 1 through the suction tube 18 and the diaphragm valve 41. The third storage and collection container 44 contains distilled or deionized washing water and communicates with the treatment container 1 through the suction tube 19 and the valve 16 (not visible in FIG. 4).

Pressurized air is conveyed from pipe 45 into the storage and collection containers 42, 43 and 44, as well as to the diaphragm valves 7, 16 and 41, by means of the pipe 45 and of the valves 46, 47, 48, 49, 50, 51.

The complete lack of dead corners in the apparatus realized according to the present invention, ensures the complete emptying out of the treatment container, thus eliminating the danger that treatment fluids pollute one another.

In order to automatize the sequence of the working stages, an exchange system schematically indicated in FIG. 4, is connected to the above described apparatus, comprising one or more timers that can be so programmed as to allow for both quick and normal treatment cycles, and fitted in an electronic circuit which controls the interventions of the different valves according to the opening and closing sucession required by the cycle to be performed.

The whole apparatus is enclosed in a case 52 provided, on two sides at least, with portholes 53 and 54 suitable to permit the introduction of the operator's hands into the container and the positioning of the plates in the treatment container 1, in the absence of light by means of the flexible closing curtains 55 and 56.

The development treatment cycle of X-ray films includes a first phase of film treatment with a developing solution, around pH13–14 generally based on hydroquinone and sulphides, followed by a treatment phase with a pH3 fixing solution and a following washing phase with water, after which the cycle starts again according to a preset time programme.

Bearing in mind the above exposition, the utilization and working of the apparatus object of the invention may be summarized as follows:

the plate to be developed is introduced, by means of support bars or the like, into treatment container 1. Then, pressurized air is conveyed in the first storage and collection container, 42 by means of pipe 45 filled with developing solution sufficient to cause the rising of the fluid into the treatment container through the respective diaphragm valve, which is kept open. Then, the valve is closed for the preset time for the development phase; the valve is then opened once again and the developing solution can return in this way, by gravity, into its storage and collection container.

Pressurized air is then conveyed into the container of the fixing solution, causing the latter to rise into container 1 through the respective diaphragm valve, and the same process is followed as in the development phase, until the fixing solution returns from container 1 into its storage container, on fixing completion.

The plate is then washed in the same way, by conveying deionized water from the respective container or by conveying mains water, through the respective diaphragm valve, and after a preset time, the water is discharged.

If so required, fluids may have been previously thermostated.

Therefore, the treatment cycle is wholly automatically controlled without mechanical parts being in movement, without danger of damages happening to said mechanical parts and without danger of even a minor mixing of the two treatment fluids, as said diaphragm valves, as conformed and placed according to the present invention, eliminate any possibility of fluid stagnation within the valves, the treatment container and the connecting ducts.

Besides, the apparatus object of the present invention offers the advantage of utilizing services, such as water and compressed air, that are always available and normally and commonly used in dentist's surgery, with no need therefore of acquiring new and expensive systems for the operation of the apparatus.

I claim:

1. An apparatus for quick and automatic development of X-ray films and plates, comprising:

a treatment container for containing X-ray films and plates to be developed, said container having a bottom with a substantially trapezoidally-shaped catch well, said container having opposite side walls and holes formed through both opposite side walls, the lowest point of the circumference of said holes being on the same level and flush with the bottom of said trapezoid catch well, said holes being shaped to form slide and ledge housings for a tight-fitting closing element of a diaphragm valve;

a first storage and collection container and a second storage and collection container, said first container containing a developing solution and said second container containing a fixing solution, and a third storage and collection container containing distilled or deionized washing water, a suction tube communicating with said holes, said treatment container being securely connected to each of said storage and collection containers;

a diaphragm valve associated with each of said holes, placed between said storage and collection containers and said treatment container within said suction tubes, said diaphragm valves being provided with a tight-fitting closing element so that said element, once closed, is on the same level and flush with the edge of said hole and, therefore, on the same level and flush with said bottom of said catch well;

means for conveying pressurized air into said storage and collection containers, so as to convey intermittently and for preset periods of time the developing solution, the fixing solution and then the washing water into said treatment container, with a spontaneous return, by gravity, of said fluids after the treatment cycle into the same storage and collection container from which each fluid has been drawn through said holes and said suction tubes;

a case enclosing said treatment container, said case having openings with flexible closing curtains covering the openings, suitable to permit the introduction of an operator's hands for the positioning of X-ray plates in said treatment container, in the absence of ambient light;

said valves being driven in succession, according to a preset time intervention program for automatic succession of treatment cycles, by an electronic control exchange system with incorporated timers, programmable and adjustable according to the duration required for the treatment cycles and the characteristics of the fluids utilized.

2. An apparatus according to claim 1, wherein the treatment container has three holes formed therethrough, two of said holes being adjacent each other in one of the side walls of said treatment container, the third hole being in the opposite side wall.

3. An apparatus according to claim 1, wherein said diaphragm valves are pneumatically driven and comprise two diaphragms, at least one return spring and a closing head translatable in both directions, said head being, upon closure, flush with the bottom of said catch well.

4. An apparatus according to claim 1, wherein said wall of said treatment container has a substantially partially spherically formed recess formed therein, and wherein said diaphragm valves are of the automatically driven type and comprise a box-shaped body communicating with a source of compressed air or other suitable fluid and a diaphragm suitable to adhere, upon closure, under the action of pressure, to the recess in the wall of said treatment container, said hole on the same level and flush with the bottom of said trapezoid catch well and a further hole communicating with said storage and collection container being provided in said partially spherically formed recess.

* * * * *